US007575710B2

(12) United States Patent
Bissonnette

(10) Patent No.: US 7,575,710 B2
(45) Date of Patent: Aug. 18, 2009

(54) HIGH FLOW GAS SAVER

(76) Inventor: Claude Bissonnette, c/o 368 Balmoral Ave., Cornwall, ON (CA) K6H 6K1

( * ) Notice: Subject to any disclaimer, the term of this patent is extended or adjusted under 35 U.S.C. 154(b) by 242 days.

(21) Appl. No.: 11/681,264

(22) Filed: Mar. 2, 2007

(65) Prior Publication Data

US 2008/0210783 A1 Sep. 4, 2008

(51) Int. Cl.
*B05B 7/04* (2006.01)

(52) U.S. Cl. ..... 266/48

(58) Field of Classification Search ..... 266/48
See application file for complete search history.

(56) References Cited

U.S. PATENT DOCUMENTS 2,043,982 A 6/1936 Bruneau
3,161,226 A * 12/1964 Stoneberg et al. ..... 239/412
3,299,939 A 1/1967 Marra, Sr.
4,818,220 A 4/1989 Kobayashi
5,383,650 A 1/1995 Bissonnette
5,390,855 A 2/1995 Mims et al.
5,470,227 A 11/1995 Mims et al.
5,792,281 A 8/1998 Diehl
6,451,245 B2 9/2002 Pisot et al.

* cited by examiner

*Primary Examiner*—Scott Kastler
(74) *Attorney, Agent, or Firm*—Ogilvy Renault LLP

(57) ABSTRACT

A gas flow control system for a gas fuelled torch including four gas passages controlled by four on-off valves and a control device. The control device can be used to actuate the valves in different combinations, thereby shutting off both fuel and oxygen flows, or allowing a full rate of fuel and oxygen flows for operational performances, or allowing only a restricted rate of fuel and oxygen flows for a pilot flame of the torch.

18 Claims, 8 Drawing Sheets

HIGH FLOW GAS SAVER

TECHNICAL FIELD

The present invention relates to gas fuelled torches, and in particular to a gas flow control system for serving a gas fuelled torch that operates in a pilot mode between active worker performances.

BACKGROUND OF THE INVENTION

Gas fuelled torches are commonly used for metal work such as cutting torches and scarfing torches. Scarfing torches employ a stream of oxygen gas and are used in the steel manufacturing industry to remove surface defects and impurities. Cutting torches are generally recognized to be one of the most efficient methods of cutting metal. In industrial processes for cutting slab steel at a casting or rolling mill and the like, cutting torches are often operated continuously. Such torches are occasionally damaged or subjected to blow out. Because an industrial process of this type cannot be halted to replace or repair torch equipment, a standby torch is generally kept lit and operating around the clock so that it can be used if the primary torch fails. The repeated and continuous operation of a standby torch consumes large quantities of gas fuel and compressed oxygen.

In other metal cutting applications using gas fuelled torches, the torch is often used sporadically while material marking, placement or other arrangements of material or personnel are in process. Shutting off a gas fuelled torch for short periods of time between jobs is considered to be inefficient because flame settings must be re-established each time torches are turned on and re-lit. Consequently, the torch is conventionally left on continuously, and may consume significant quantities of fuel and compressed oxygen between active work performances.

It is therefore desirable to provide a gas flow control system for a gas fuelled torch so as to change the torch operation modes without interference with the established flame settings of the torch.

SUMMARY OF THE INVENTION

One object of the present invention is to provide a gas flow control system for a gas fuelled torch.

In accordance with one aspect of the present invention there is provided a gas flow control system for a gas fuelled torch which comprises a first fluid passage having a first inlet adapted to be connected to an external fuel gas source and a first outlet adapted to be connected to the gas fuelled torch; a second fluid passage having a second inlet adapted to be connected to an external oxygen source and a second outlet adapted to be connected to the gas fuelled torch; a first on-off valve in the first fluid passage controllable only between a fully open position and a closed position; a second on-off valve in the second fluid passage controllable only between a fully open position and a closed position; a first bypass passage in fluid communication with the first fluid passage, bypassing the first on-off valve; a third on-off valve in the first bypass passage controllable only between a fully open position and a closed position; a second bypass passage in fluid communication with the second fluid passage, bypassing the second on-off valve; a fourth on-off valve in the second bypass passage controllable only between a fully open position and a closed position; and means for selectively actuating the individual first, second, third and fourth on-off valves in different combinations, thereby forming a first operational mode wherein all passages are closed, a second operational mode wherein the first and second fluid passages are open, and a third operational mode wherein the first and second fluid passages are closed and the first and second bypass passages are open.

In accordance with another aspect of the present invention there is provided a gas flow control assembly which comprises a body defining first and second fluid passages extending through the body for receiving fuel gas and oxygen from separate external sources and controllably directing same to a gas fuelled torch, the first and second fluid passages having respective first and second bypass passages; first and second on-off valves in the respective first and second fluid passages controllable only between a fully open position and a closed position; third and fourth on-off valves in the respective first and second bypass passages controllable only between a fully open position and a closed position; a control apparatus for selectively actuating the individual first, second, third and fourth on-off valves in different combinations, thereby forming a first operational mode wherein all passages are closed, a second operational mode wherein the first and second fluid passages are open, and a third operational mode wherein the first and second fluid passages are closed and the first and second bypass passages are open.

In accordance with a further aspect of the present invention there is a gas flow control assembly provided which comprises a body defined between opposite first and second surfaces; first and second inlet ports, and second inlet and outlet ports individually defined in one or more side surfaces extending between the opposite first and second surfaces, for receiving and delivering first and second gases, respectively; first, second, third and fourth cavities defined in the first surface and extending inwardly into the body; the respective first and third cavities being in fluid communication with the first inlet and outlet ports, the respective second and fourth cavities being in fluid communication with the second inlet and outlet ports; substantially identical first, second, third and fourth valve members received in the respective cavities, each being slidable between a first position in which a related cavity is closed, preventing fluid from flowing therethrough from a related inlet port to a related outlet port, and a second position in which the related cavity is open to allow fluid to flow therethrough from the related inlet port to the related outlet port; and a control apparatus for selectively actuating the individual first, second, third and fourth valve members in different combinations, for simultaneously controlling first and second gas flows through the assembly.

BRIEF DESCRIPTION OF THE DRAWINGS

Further features and advantages of the present invention will become apparent from the following detailed description, taken in combination with the appended drawings, in which.

It should be noted that throughout the appended drawings, like features are identified by like reference numerals.

DETAILED DESCRIPTION OF THE PREFERRED EMBODIMENT

Figure 1A:
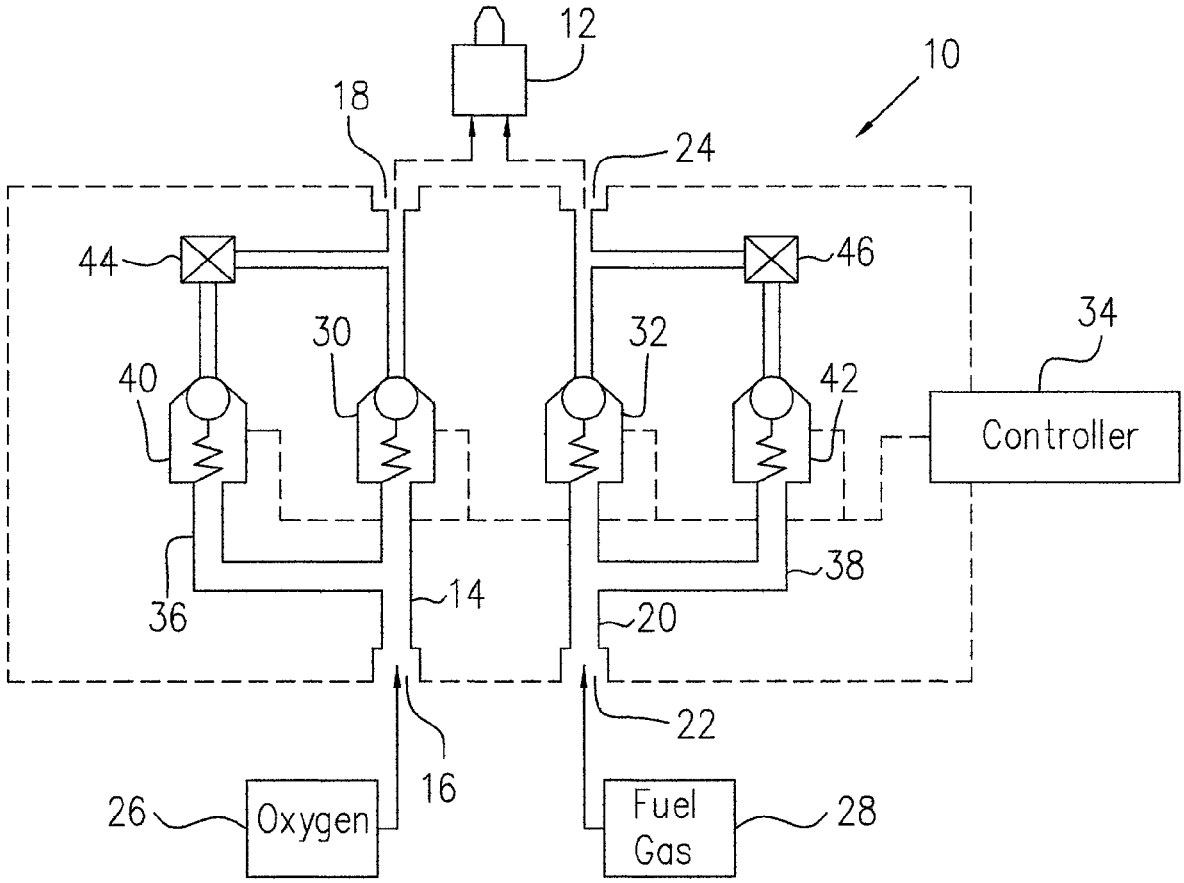
FIG. 1A is a schematic illustration of a gas flow control system according to one embodiment of the present invention, showing a first operational mode in which all flow passages are closed when the system is not in use.
Figure 1B:
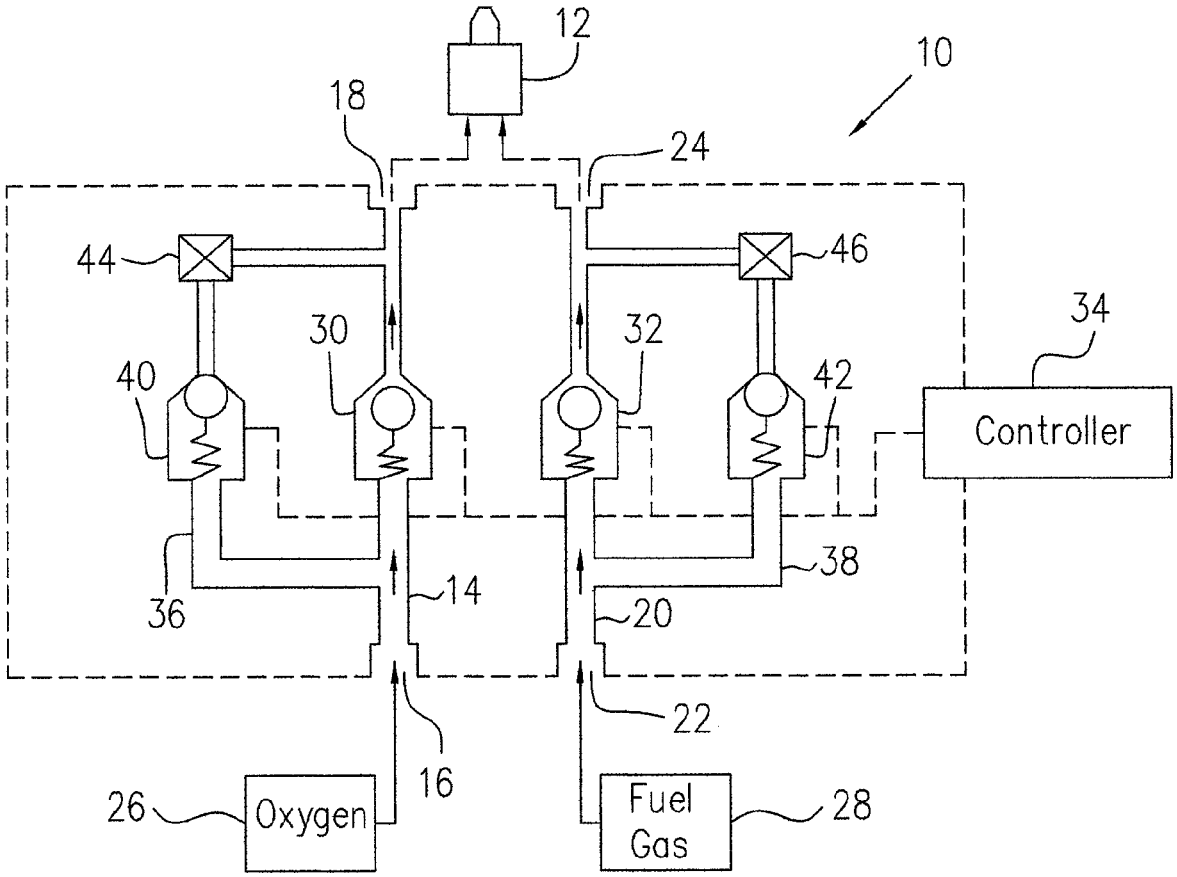
FIG. 1B is a schematic illustration of the gas flow control system of FIG. 1A, showing a second operational mode in which main fuel gas and oxygen passages are open for an active operational performance of a gas fuelled torch.
Figure 1C:
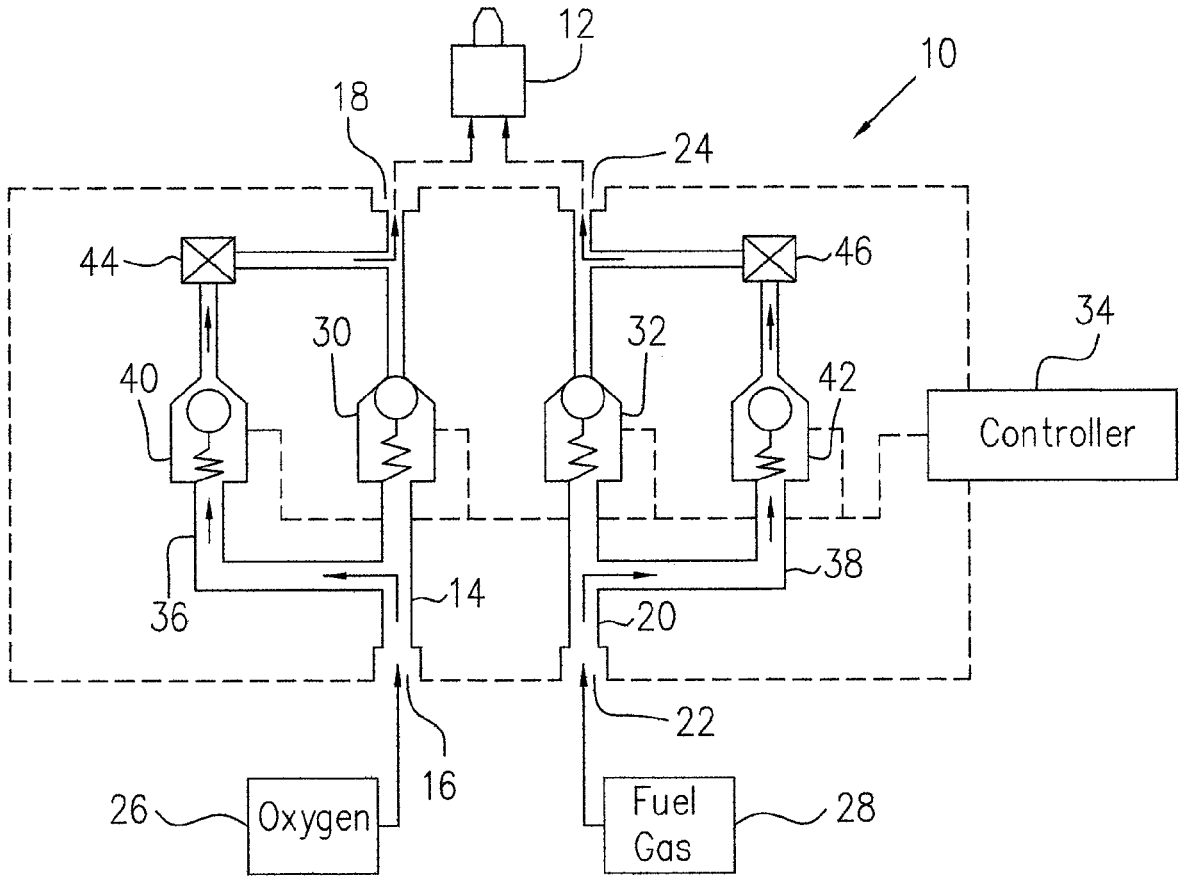
FIG. 1C is a schematic illustration of the gas flow control system of FIG. 1 showing a third operational mode in which pilot passages are open for delivering a restricted volume of fuel gas and oxygen to the related gas fuelled torch when, for example, in a stand-by condition.
Figure 2:
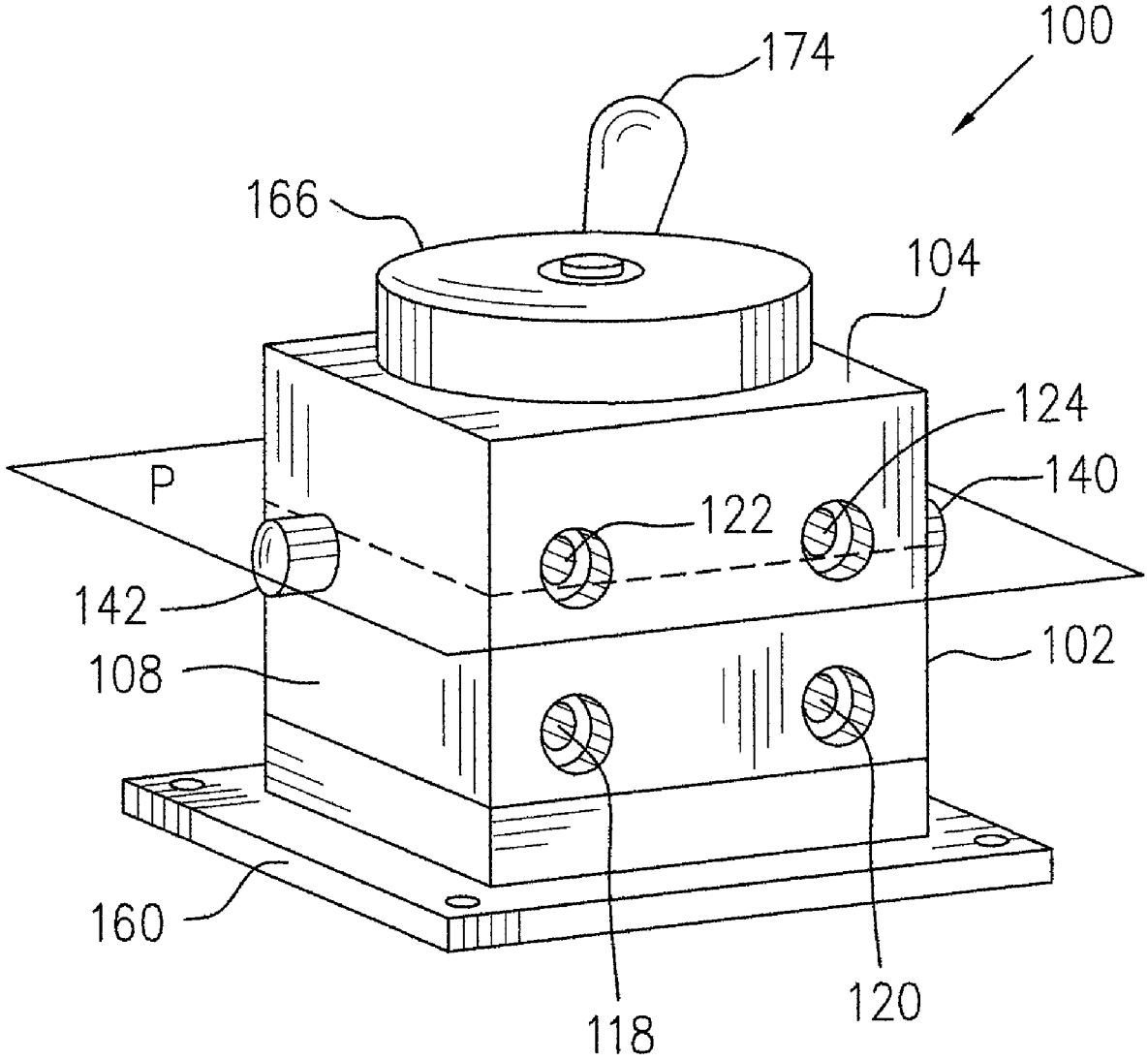
FIG. 2 is an isometric view of a gas flow control assembly according to another embodiment of the present invention.

Referring to FIGS. 1A-1C, a gas flow control system generally indicated by numeral 10 may be used as a gas saver for a gas fuelled torch to control two different types of gases simultaneously such as fuel gases and oxygen used for cutting torches and the like. The gas flow control system 10 includes main fluid passages 14 and 20, having respective inlet ports 16, 22 and outlet ports 18, 24. The inlet ports 16 and 22 are adapted to connect with separate external gas sources, such as oxygen source 26 and fuel gas sources 28 respectively, while the outlet ports 18 and 24 are adapted to connect with the gas fuelled torch 12. Therefore, the gas flow control system 10 may function as an additional gas flow control apparatus, in contrast to gas control/flame setting devices (not shown) of the gas fuelled torch 12, and may be located separately from or incorporated into the gas fuelled torch 12.

The main fluid passages 14 and 20 include respective on-off valves 30 and 32 selectively actuated by controller 34. The on-off valves 30, 32 can be controlled to switch between a closed position, as shown in FIG. 1A to close the respective main fluid passage 14 and 20, thereby preventing fluid from flowing therethrough from the respective inlet ports 16, 22 to the respective outlet ports 18, 24, and fully open position as shown in FIG. 1B to open the main fluid passages 14 and 20 to allow fluid to flow therethrough from the respective inlet ports 16, 22 to the respective outlet ports 18, 24. The on-off valves 30 and 32 do not provide a stable intermediate position between the closed and fully open positions and thus allow only one flow rate at which a fluid flows through the respective main fluid passages 14 and 20. Such a flow rate is determined by the valve and passage configurations. On-off valves 30 and 32 may be, as shown for example, a spring biased and normally closed type. Alternatively, on-off valves 30, 32 may be electric solenoid valves or pneumatically actuated valves. Controller 34 may therefore be a mechanical, electric or pneumatic controller accordingly.

The gas flow control system 10 further includes bypass pilot passages 36, 38 which are in fluid communication with the respective main fluid passages 14, 20, bypassing the respective on-off valves 30 and 32. Bypass pilot passages 36 and 38 include respective on-off valves 40, 42 which provide a function similar to that provided by the respective on-off valves 30 and 32, and will not be redundantly described herein. On-off valves 40, 42 may be selected from any one of the types which include mechanical, electric, solenoid and pneumatically actuated valves. It is desirable but not necessary, to have an identical configuration of on-off valves 30, 32, 40 and 42 in order to simplify the gas flow control system 10, particularly the controller configuration.

On-off valves 40, 42 when open, allow a predetermined flow rate at which a fluid flows through the respective bypass pilot passages 36, 38 from inlet ports 16, 22 to outlet ports 18, 24, respectively. It is desirable but not necessary, that the bypass pilot passages 36 and 38 are configured to allow a restricted flow rate to pass therethrough with respect to the flow rate allowed by the main fluid passages 14 and 20. Therefore, the gases, such as oxygen and fuel gases delivered by the system 10 to the gas fuelled torch 12 can be simultaneously controlled from a full flow rate (when passing through the main fluid passages 14 and 20) to a restricted or pilot flow rate (when passing through bypass pilot passages 36 and 38).

Optionally, bypass pilot passages 36 and 38 may include an adjustable fluid flow metering device 44 and 46 such that the restricted flow rate allowed by the respective bypass pilot passages 36 and 38 can be pre-adjusted before a torch operation is carried out.

Controller 34 is configured for selectively actuating the individual on-off valves 30, 32, 40 and 42 in different combinations to simultaneously control the respective oxygen and fuel gas flows through the gas flow control system 10 for delivery to the gas fuelled torch 12. In one arrangement of the controller settings, controller 34 provides a first operational mode wherein all on-off valves 30, 32, 40 and 42 are closed, as shown in FIG. 1A, a second operational mode wherein on-off valves 30 and 32 are open while on-off valves 40 and 42 remain closed as shown in FIG. 1B and a third operational mode wherein on-off valves 30 and 32 are closed while on-off valves 40 and 42 remain open as shown in FIG. 1C. In another arrangement of the controller settings, the controller 34 provides three operational modes similar to the three modes in the previous arrangement, however in the second operational mode all on-off valves 30, 32, 40 and 42 are in the open position (not shown) in contrast to the second mode in the previous arrangement as shown in FIG. 1B. The controller settings may also be arranged in other modes for a specifically desired control function.

An exemplary operation process is further described when the controller setting, for example, is arranged as illustrated in FIGS. 1A-1C in order to illustrate the utility of the present invention. In operation, all on-off valves 30, 32, 40 and 42 are closed and no fluid flows are allowed to pass through the gas flow control system 10 from the respective inlet ports 16 and 22 to the outlet ports 18 and 24, as shown in FIG. 1A. The gas flow control system 10 is then connected to the respective oxygen and fuel gas sources 26, 28 as well as the gas fuelled torch 12. The respective oxygen fuel gas sources 26, 28 are adjusted to obtain proper oxygen and fuel gas pressures according to the specific requirements of the gas flow control system 10 and the gas fuelled torch 12. The respective adjustable flow metering devices 44 and 46 are adjusted to their maximum open level. The controller 34 is then changed to its second mode as shown in FIG. 1B to allow oxygen and fuel gas to flow through the main fluid passages 14 and 20 to the gas fuelled torch 12 to be ignited, providing a main flame which is for a normal torch operation such as pre-heating or cutting operation. At this stage the operator may adjust the oxygen and gas flow setting devices (not shown) on the torch 12 to adjust the main flame according to the proper manufacturer's settings to perform in its required operational function such as cutting, scarfing, heating, etc. The next step is to operate the controller 34 to shift the on-off valves 30, 32, 40 and 42 into the third mode as shown in FIG. 1C to allow the respective oxygen and fuel gas to flow through the bypass pilot passages 36 and 38 instead of through the main fluid passages 14 and 20. At this moment, the flame of the torch 12 remains substantially same as the main flame in the first operational mode as shown in FIG. 1B because the respective adjustable flow metering devices 44, 46 are adjusted at their maximum open level. Now the respective adjustable flow metering devices 44 and 46 may be gradually turned down until the torch flame is nearly extinguished, in order to sustain a pilot flame when the equipment is not in use but in a stand-by condition and will be immediately available in case of immediate need or emergency. The system 10 is now ready to be instantly switched between the second and third operational modes for a stand-by condition and a fully operational condition, and may also be switched to the first operational mode to completely shut down the oxygen and fuel gas supplies to the gas fuelled torch.

The gas flow control system 10 of the present invention advantageously provides additional and convenient control of the oxygen and fuel gas supply to the gas fuelled torch 12, independent from the adjustment of oxygen and fuel gas flows by the flow volume setting devices of the gas fuelled torch 12. The gas flow control system 10 also functions as a safety switch to immediately shut down both oxygen and fuel gas supplies to the gas fuelled torch 12 when the torch has failed.

Reference is now made to FIGS. 1A-6, the gas flow control system 10 of the present invention may be implemented, for example, as a gas flow control assembly 100 (see FIG. 2) according to another embodiment of the present invention. The gas flow control assembly 100 includes a body 102 which may be made of a metal or plastic material in any suitable shape (such as a block in this embodiment) including a top surface 104 and a bottom surface 106 (see FIG. 6) in a substantially parallel and opposite relationship. Four side surfaces 108 are defined and extend between the top and bottom surfaces 104, 106. First, second, third and fourth cavities 110, 112, 114 and 116 which are substantially identical in this embodiment, but could be configured differently, are defined in the body 102. Each of the cavities 110-116 extends inwardly from the bottom surface 106 of the body 110, defining a lower section 110*a*, 112*a*, 114*a* or 116*a* with a relatively large diameter, a middle section 110*b*, 112*b*, 114*b*, or 116*b* with a intermediate diameter, and an upper section 110*c*, 112*c*, 114*c* or 116*c* with a relatively smaller diameter. The upper sections 110*c*, 112*c*, 114*c* and 116*c* preferably extend through the top surface 104 of the body 102.

Two inlet ports 118, 120 and two outlet ports 122, 124 are defined in the body 102, for example, in one side surface 108. Optionally, two additional outlet ports 126, 128 are also defined in the body 102, for example, in a side surface 108 opposite to that in which the inlet and outlet ports 118, 120, 122 and 124 are defined. Cavity 110 is in fluid communication with inlet port 118 and outlet ports 122, 126 through holes 130 132 and 134 (See FIG. 4). Hole 130 extends between the inlet port 118 and lower section 110*a*, and holes 132, 134 extend between the middle section 110*b* and the respective outlet ports 122, 126. Cavity 112 is in fluid communication with the respective inlet port 120 and outlet ports 124, 128 in a similar way, and will not be redundantly described herein. Therefore, cavity 110 with the holes 130, 132 and 134 forms the main fluid passage 14 of the gas flow control system 10. Similarly, cavity 112 with its fluid communicating holes to the respective inlet/outlet ports 120, 124 and 128, forms the main fluid passage of the gas flow control system 10.

Body 102 further defines two small cavities 136, 138 (See FIG. 3), for example, in two opposite side surfaces 108, substantially normal to the opposite side surfaces 108 in which the inlet/outlet ports 118-128 are defined. The small cavities 136, 138 each receive an adjustable gas metering device 140 or 142 which is accessible and adjustable from outside of the body 102. Small cavity 136 is in fluid communication through an inner passage 144, with cavity 114 at the middle section 114*b* (see FIG. 6). Small cavity 136 is further in fluid communication through an inner passage 146 with one hole 130 (also see FIG. 6) leading to outlet port 122 (see FIG. 3). Another inner passage 148 (see FIG. 5) is provided to interconnect cavities 110 and 114 at the respective lower sections 110*a* and 114*a*. Therefore, the cavity 114 with the inner passage 148 at its lower section 114*a* and inner passage 144 at its middle section 114*b*, together with the small cavity 136 (including the adjustable gas flow metering device 14 mounted therein) and inner passage 146, in combination form the bypass pilot passage 36 of the gas flow control system 10. Similarly, small cavity 138, cavities 112 and 116 are in fluid communication through inner passages which are similar to the inner passages 144, 146, 148. Therefore, the cavity 116 and small cavity 138 (with the adjustable gas flow metering device 142 mounted therein) with their inner passages, in combination form the bypass pilot passage 38 of the gas flow control system 10, which will not be redundantly described herein.

Figure 3:
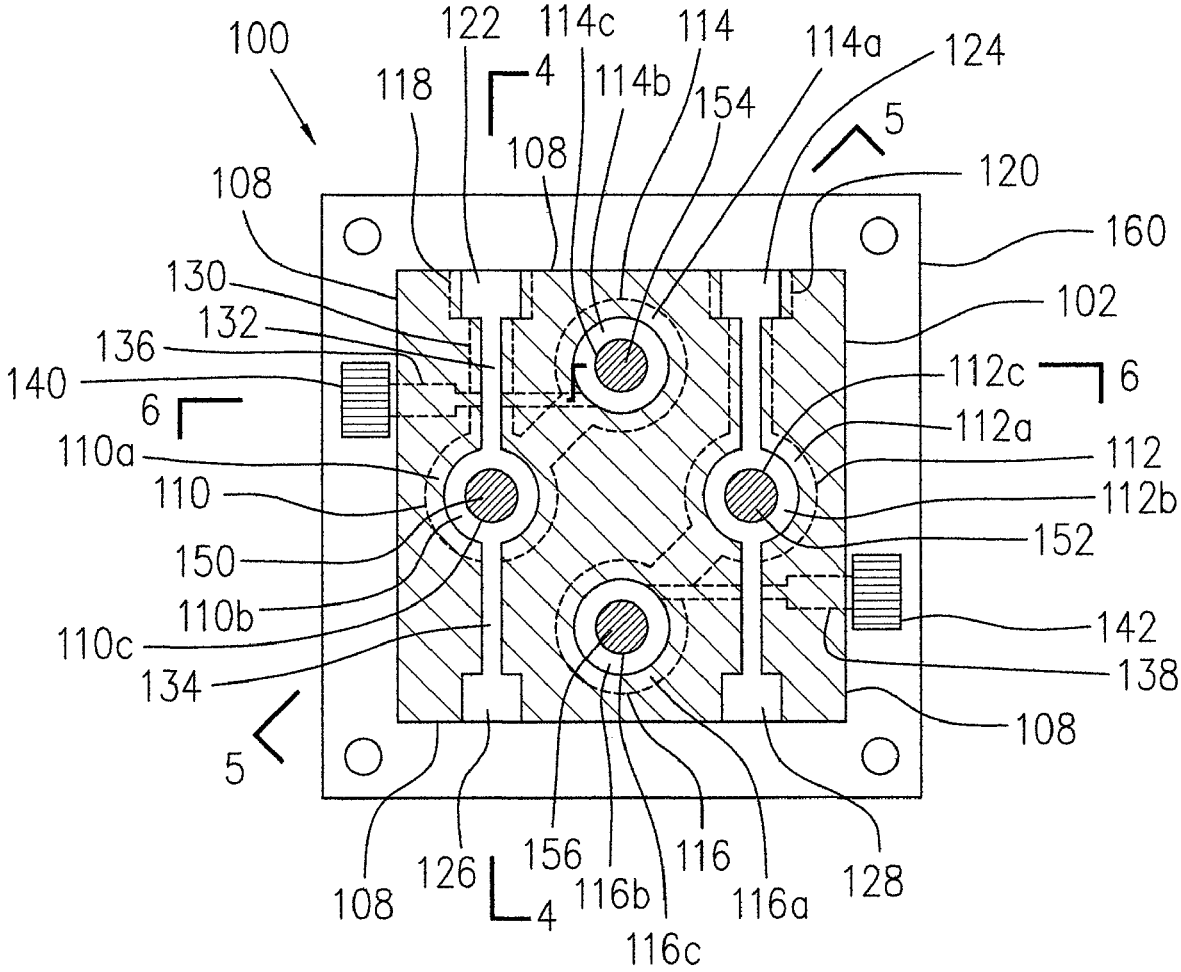
FIG. 3 is a cross-sectional view of the gas flow control assembly, taken on the plane P shown in FIG. 2.
Figure 4:
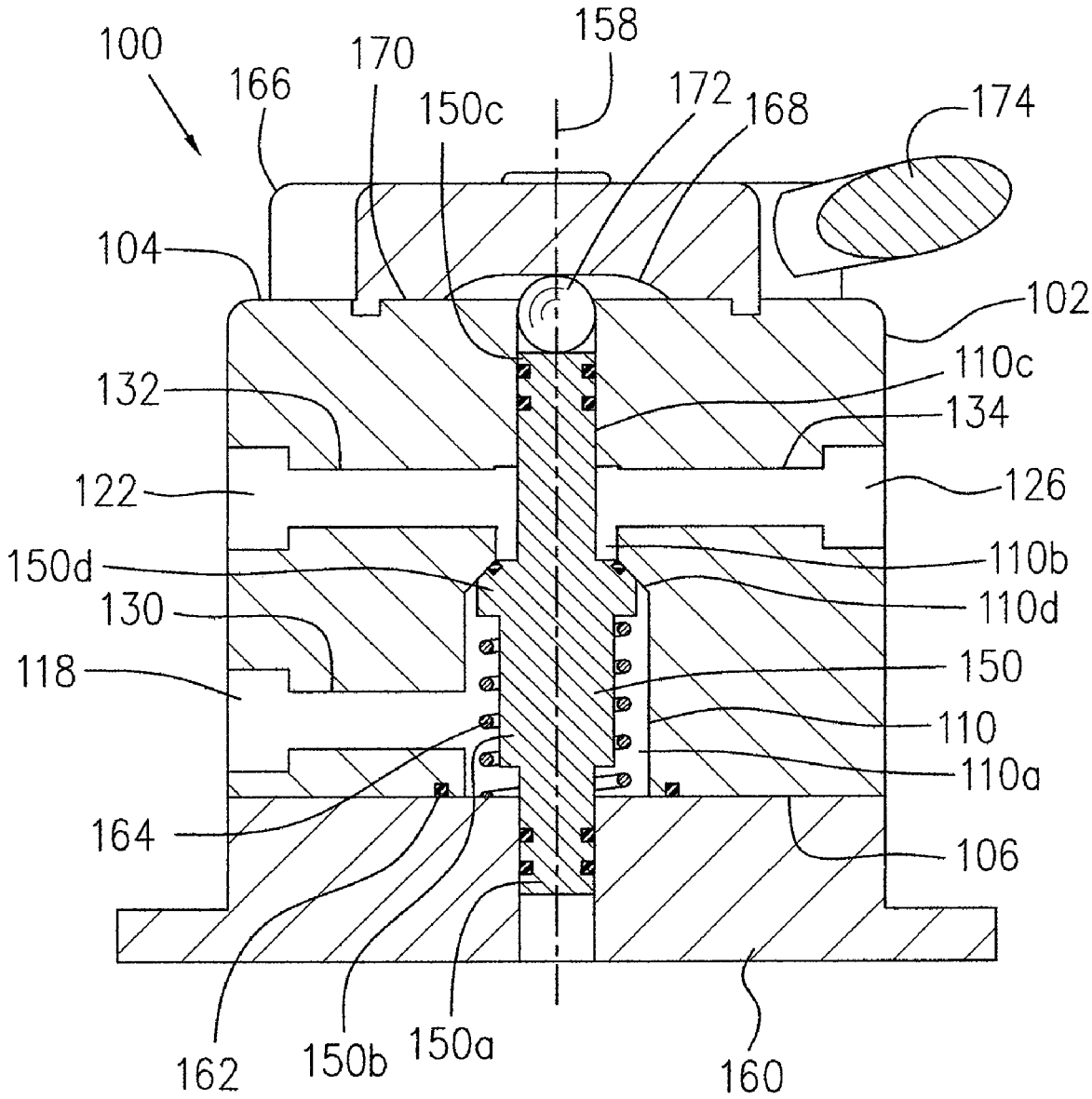
FIG. 4 is cross-sectional view of the gas flow control assembly, taken along line 4-4 of FIG. 3, showing one of the cavities in fluid communication with inlet and outlet ports.
Figure 5:
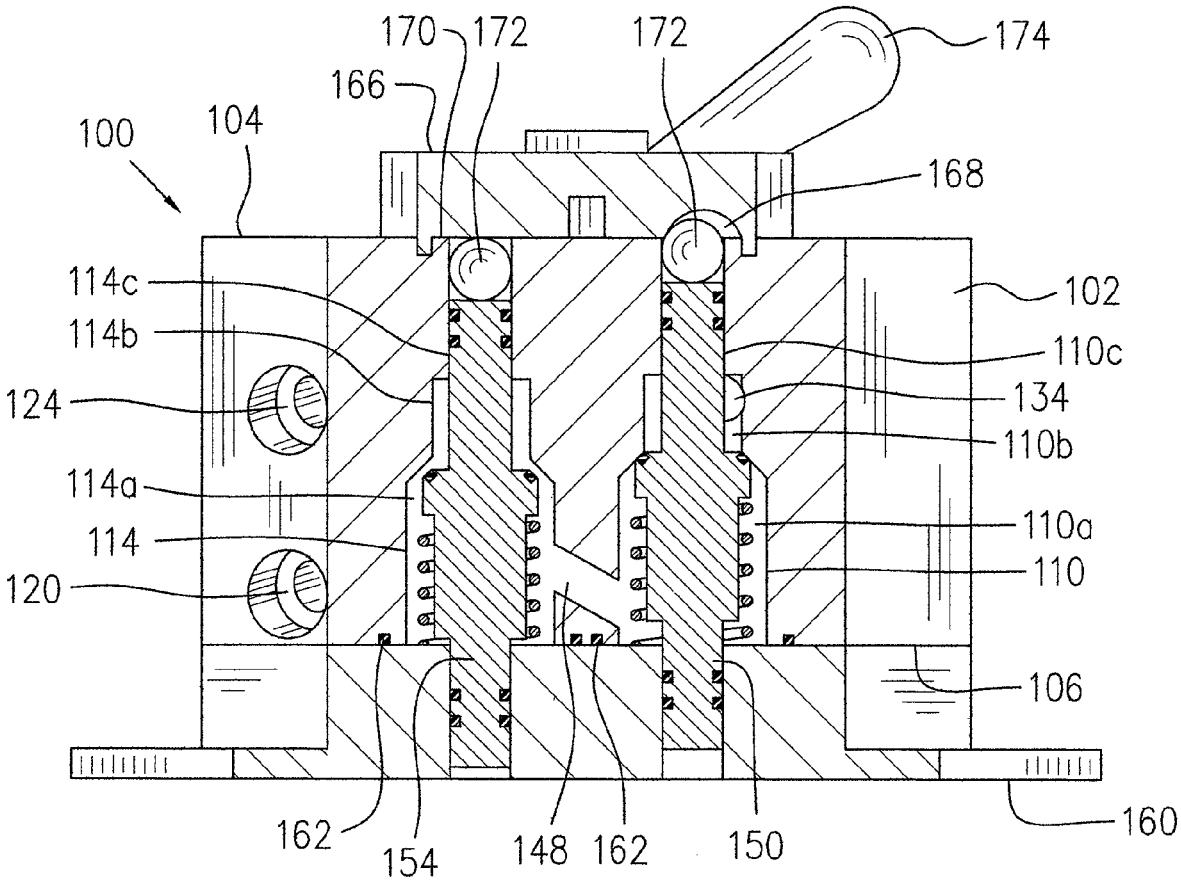
FIG. 5 a cross-sectional view of the gas flow control assembly, taken along line 5-5 of FIG. 3, showing an inner passage interconnecting two cavities.
Figure 6:
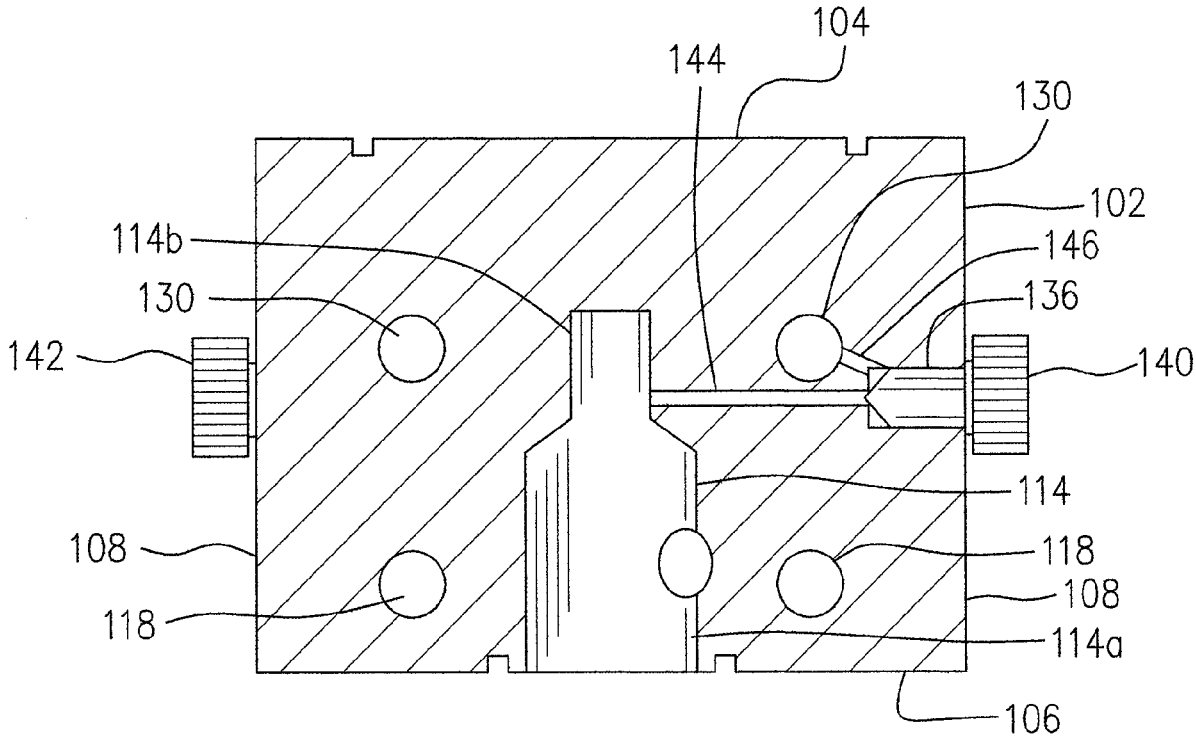
FIG. 6 is a cross-sectional view of the gas flow control assembly, taken along line 6-6 in FIG. 3, with a cam on the top of the body, a base plate and all valve members removed.

An on-off valve 150, 152, 154 or 156 is operatively placed in each of the cavities 110, 112, 114 and 116 (see FIG. 3). On-off valves 150, 152, 154 and 156 may be identical, especially when all the cavities are of similar configurations. For convenience of description, only on-off valve 150 is described with further details. As more clearly shown in FIG. 4, on-off valve 150 has lower and upper stem sections 150*a*, 150*c*, optionally having an equal diameter which is slightly smaller than the diameter of the upper section 110*c* of the cavity 110 in order to allow the on-off valve 150 to be guided by the upper section 110*c* for a sliding motion along an axis 158 of the cavity 110. A valve body 150*b* with a radially enlarged shoulder 150*d* is provided between the lower and upper stem sections 150*a*, 150*c*. The valve body 150*b* is configured to move within the lower cavity 110*a* between an upper position in which the radially enlarged shoulder 150*d* of the valve body 150*b* abuts an annular valve seating surface 110*d* positioned between the lower and middle sections 110*a* and 110*b*, thereby closing the cavity 110 to prevent fluid communication between the lower and middle sections 110*a* and 110*b*, and a lower position in which the radially enlarged shoulder 150*d* is moved down away from the annular valve seating surface 110*d*, thereby opening the cavity 110 to allow fluid communication between the lower and middle sections 110*a* and 110*b*, as similarly illustrated by on-off valve 154 in FIG. 5.

A base plate 160 is optionally provided to be attached to the bottom surface 106 of body 102 in order to seal the openings of the respective cavities 110, 112, 114 and 116, for example by mounting screws and/or positioning pins (not shown). The base plate 160 may include holes (not indicated) extending therethrough for slidably receiving the lower stem sections of the respective on-off valve 150, 152, 154 and 156 in a manner similar to that of the upper sections 110*c*, 112*c*, 114*c* and 116*c* of the cavities 110, 112, 114 and 116 slidably receiving the respective upper stem sections of the on-off valves 150, 152, 154, 155. O-ring seals (not indicated) may be provided around the respective lower and upper stem sections of on-off valves 150, 152, 15 and 156 in order to prevent fluid leakage. An O-ring seal (not indicated) is also provided on the radially enlarged shoulder of the respective on-off valves 150, 152, 15 and 156 to be pressed against the corresponding annular valve seating surface of the respective cavities 110, 112, 114 and 116 when the respective on-off valve 150, 152, 154 and 156 is in the upper (closed) position. Furthermore, a circular groove (not indicated) may be provided in either or both abutting surfaces of body 102 and base plate 160 to receive and position an O-ring seal 162 around each of the cavities 110, 112, 114 and 116 in order to prevent fluid leakages between the abutting surfaces of body 102 and base plate 160.

Coil springs 164 (see FIG. 4) are provided within the respective lower sections 110*a*, 112*a*, 114*a* and 116*a* of the cavities 110, 112, 114 and 116 and around the respective valve bodies of on-off valves 150, 152, 154 and 156, to urge the respective valves to their upper (closed) positions. Therefore, on-off valves 150, 152, 154 and 156 are normally closed.

A cam 166 is rotatably mounted to the top surface 104 of body 102 and defines a plurality of recesses which are generally indicated by numeral 168, in a bottom surface 170 of the cam 166. Four balls 172 are placed in the respective upper sections of the cavities 110, 112, 114 and 116, at the top of the respective on-off valve 150, 152, 154 and 156 so that each of the on-off valves 150, 152, 154 and 156 can be pushed down to the open position when the related ball 172 is pressed down by the bottom surface 170 of the cam 166 (as shown by on-off valve 154 in FIG. 5) or can be urged up by the related coil spring 164 to the open position when the related ball 172 is pushed to project from body 102 and is partially accommodated by one of the recesses 168 of the cam 166 (as shown by the on-off valve 150 in FIGS. 4 and 5).

The plurality of recesses 168 are configured and distributed in cam 166 such that all balls 172 are allowed to be projected to have all on-off valves 150, 152, 154 and 156 in the closed position when the cam 166 is in a first angular position, or when the cam 166 is in a second angular position only balls 172 related to on-off valves 154 and 156 (see FIG. 3) are allowed to project in order to have on-off valves 154 and 156 in the closed position while on-off valves 150 and 152 are pressed down to the open position, or when cam 166 is in a third angular position only balls 172 related to on-off valves 150, 152 are allowed to project to have on-off valves 150 and 152 in the closed position while on-off valves 154 and 156 are pressed down to the open position. A handle 174 may be mounted to cam 166 to provide convenience of rotating the cam 166 among those three angular positions.

It should be noted that the gas flow control assembly 100 is only one of the implementations of the gas flow control system 10. The operation of the gas flow control assembly 100 is similar to the gas flow control system 10 and will not be redundantly described.

It should also be noted that as a controller apparatus, cam 166 may provide other controlling modes for the respective on-off valves 150, 152, 154 and 156 depending on the configuration and relative locations of recesses 168 defined in cam 166, in order to meet different operational requirements.

The above description is meant to be exemplary only and one skilled in the art will recognize that changes may be made to the embodiments describe without departure from the scope of the invention disclosed. For example, the cam assembly which was described for the embodiment of the gas flow control assembly may be replaced by any other type of controlling apparatus. The body of the gas flow control assembly may be made in any other shape, such as cylindrical, and the particular configuration of passages defined in the body may be altered. Still other modifications which fall within the scope of the present invention will be apparent to those skilled in the art, in light of a review of this disclosure, and such modifications are intended to fall within the appended claims.

I claim:

1. A gas flow control system for a gas fuelled torch, comprising:

a first fluid passage having a first inlet adapted to be connected to an external fuel gas source and a first outlet adapted to be connected to the gas fuelled torch;

a second fluid passage having a second inlet adapted to be connected to an external oxygen source and a second outlet adapted to be connected to the gas fuelled torch;

a first on-off valve in the first fluid passage controllable only between a fully open position and a closed position;

a second on-off valve in the second fluid passage controllable only between a fully open position and a closed position;

a first bypass passage in fluid communication with the first fluid passage, bypassing the first on-off valve;

a third on-off valve in the first bypass passage controllable only between a fully open position and a closed position;

a second bypass passage in fluid communication with the second fluid passage, bypassing the second on-off valve;

a fourth on-off valve in the second bypass passage controllable only between a fully open position and a closed position; and a control apparatus having physical links to the respective on-off valves for selectively and simultaneously actuating the individual first, second, third and fourth on-off valves in different combinations, thereby forming a first operational mode wherein all passages are closed, a second operational mode wherein the first and second fluid passages are open, and a third operational mode wherein the first and second fluid passages are closed and the first and second bypass passages are open.

2. The system as defined in claim 1 wherein the first and second bypass passages are configured to allow a restricted flow rate of respective fuel gas and oxygen, with respect to the first and second fluid passages.

3. The system as defined in claim 2 wherein each of the first and second bypass passages comprises an adjustable fluid flow metering device.

4. The system as defined in claim 1 wherein all the on-off valves are normally closed valves.

5. The system as defined in claim 1 wherein the system is incorporated into the gas fuelled torch.

6. A gas flow control assembly, comprising:

a body defining first and second fluid passages extending through the body for receiving fuel gas and oxygen from separate external sources and controllably directing same to a gas fuelled torch, the first and second fluid passages having respective first and second bypass passages;

first and second on-off valves in the respective first and second fluid passages controllable only between a fully open position and a closed position;

third and fourth on-off valves in the respective first and second bypass passages controllable only between a fully open position and a closed position;

a control apparatus having physical links to the respective on-off valves for selectively and simultaneously actuating the individual first, second, third and fourth on-off valves in different combinations, thereby forming a first operational mode wherein all passages are closed, a second operational mode wherein the first and second fluid passages are open, and a third operational mode wherein the first and second fluid passages are closed and the first and second bypass passages are open.

7. The gas flow control assembly as defined in claim 6 wherein the body defines a cavity for operatively receiving each of the on-off valves.

8. The gas flow control assembly as defined in claim 7 wherein each of the on-off valves comprises a valve member slidable in the cavity, the valve member being urged by a spring from the fully open position to the closed position.

9. The gas flow control assembly as defined in claim 8 wherein the control apparatus comprises a cam assembly rotatable among three positions corresponding to the respective operational modes, selectively pressing the respective valve members against spring forces to move from the closed position to the fully open position.

10. The gas flow control assembly as defined in claim 6 wherein each of the bypass passages comprises an adjustable fluid flow metering device.

11. The gas flow control assembly as defined in claim 6 wherein the body defines a first inlet port, a first outlet port, a second inlet port and a second outlet port, the first fluid passage extending between the first inlet port and the first outlet port, the second fluid passage extending between the second inlet port and the second outlet port.

12. The gas flow control assembly as defined in claim 11 wherein the body further defines a third outlet port and fourth outlet port, the third outlet port being in fluid communication with a section of the first fluid passage downstream of the first on-off valve, and the fourth outlet port being in fluid communication with a section of the second fluid passage downstream of the second on-off valve.

13. A gas flow control assembly, comprising:

a body defined between opposite first and second surfaces;

first and second inlet ports, and first and second outlet ports individually defined in one or more side surfaces extending between the opposite first and second surfaces, for receiving and delivering first and second gases, respectively;

first, second, third and fourth cavities defined in the first surf ace and extending inwardly into the body; the respective first and third cavities being in fluid communication with the first inlet and outlet ports, the respective second and fourth cavities being in fluid communication with the second inlet and outlet ports;

substantially identical first, second, third and fourth valve members received in the respective cavities, each being slidable between a first position in which a related cavity is closed, preventing fluid from flowing therethrough from a related inlet port to a related outlet port, and a second position in which the related cavity is open to allow fluid to flow therethrough from the related inlet port to the related outlet port; and a cam assembly for selectively and simultaneously actuating the individual first, second, third and fourth valve members in different combinations, for simultaneously controlling first and second gas flows through the assembly.

14. The gas flow control assembly as defined in claim 13 further comprising a base plate mounted to the first surface of the body.

15. The gas flow control assembly as defined in claim 13 wherein the respective cavities extend through the body between the opposite first and second surfaces.

16. The gas flow control assembly as defined in claim 15 wherein the cam assembly is mounted to the second surface of the body, the respective valve members being operable by the cam assembly through an open end of the respective cavities in the second surface of the body.

17. The gas flow control assembly as defined in claim 13 wherein the body further defines third and fourth outlet ports in fluid communication with the first and second cavities, respectively, such that the first valve member controls fluid flowing from the first and second inlet ports to both the first and third outlet ports, and such that the second valve member controls fluid flowing from the second inlet port to both the second and fourth outlet ports.

18. The gas flow control assembly as defined in claim 13 further comprising first and second adjustable gas flow metering devices in fluid communication with the third and fourth cavities, respectively, thereby controlling the respective first and second gas flows in the third operational mode of the gas flow control assembly.

* * * * *